US011224787B2

(12) United States Patent
Saegusa

(10) Patent No.: US 11,224,787 B2
(45) Date of Patent: Jan. 18, 2022

(54) SWING MEASUREMENT DEVICE, SWING MEASUREMENT METHOD, AND SWING MEASUREMENT PROGRAM

(71) Applicant: PRGR Co., LTD., Tokyo (JP)

(72) Inventor: Hiroshi Saegusa, Tokyo (JP)

(73) Assignee: PRGR Co., LTD.

( * ) Notice: Subject to any disclaimer, the term of this patent is extended or adjusted under 35 U.S.C. 154(b) by 0 days.

(21) Appl. No.: 16/630,835

(22) PCT Filed: Jan. 29, 2018

(86) PCT No.: PCT/JP2018/002620
§ 371 (c)(1),
(2) Date: Jan. 13, 2020

(87) PCT Pub. No.: WO2019/012721
PCT Pub. Date: Jan. 17, 2019

(65) Prior Publication Data

US 2020/0139214 A1 May 7, 2020

(30) Foreign Application Priority Data

Jul. 13, 2017 (JP) ..... JP2017-137035

(51) Int. Cl.
*A63B 69/36* (2006.01)
*A63B 60/46* (2015.01)
*A63B 24/00* (2006.01)

(52) U.S. Cl.
CPC ..... *A63B 60/46* (2015.10); *A63B 24/0003* (2013.01); *A63B 69/3632* (2013.01); *A63B 2220/10* (2013.01); *A63B 2220/40* (2013.01)

(58) Field of Classification Search
CPC . A63B 60/46; A63B 24/0003; A63B 69/3632; A63B 2220/10
(Continued)

(56) References Cited

U.S. PATENT DOCUMENTS

2006/0025229 A1* 2/2006 Mahajan ..... A63B 24/0003 473/131
2009/0018795 A1 1/2009 Priester
(Continued)

FOREIGN PATENT DOCUMENTS

EP 3 164 271 5/2017
JP 2006-327245 12/2006
(Continued)

OTHER PUBLICATIONS

International Search Report for International Search Report PCT/JP2018/002620 dated Apr. 17, 2018, 4 pages, Japan.
(Continued)

*Primary Examiner* — Nini F Legesse
(74) *Attorney, Agent, or Firm* — Thorpe North & Western

(57) ABSTRACT

A swing measurement system measures an evaluation index of a swing of a golf club using an inertial sensor. A computer is provided with: a movement trajectory calculation unit for calculating a movement trajectory of the golf club during the swing using a detection value of the inertial sensor; a shaft plane calculation unit for calculating a shaft plane of the swing based on the movement trajectory in a freely selectable section of the swing; and an angle calculation unit for calculating, as the evaluation index, a shaft plane angle formed between the face surface of the golf club and the shaft plane.

11 Claims, 20 Drawing Sheets

(58) Field of Classification Search
USPC ..... 473/221–223, 219, 409
See application file for complete search history.

(56) References Cited

U.S. PATENT DOCUMENTS

| | | | | |
|---|---|---|---|---|
| 2013/0139937 | A1 | 6/2013 | Gayton et al. | |
| 2013/0150174 | A1 | 6/2013 | Priester et al. | |
| 2014/0379293 | A1* | 12/2014 | Sato | A61B 5/1122 702/141 |
| 2014/0379295 | A1* | 12/2014 | Sato | G01P 15/02 702/142 |
| 2015/0111657 | A1* | 4/2015 | Shibuya | A63B 69/3632 473/223 |
| 2015/0285834 | A1* | 10/2015 | Shibuya | G01P 15/0802 702/150 |
| 2016/0175650 | A1* | 6/2016 | Sato | A61B 5/11 702/151 |
| 2017/0120124 | A1 | 5/2017 | Hagiwara | |
| 2017/0203188 | A1* | 7/2017 | Sato | A61B 5/486 |
| 2017/0274256 | A1* | 9/2017 | Brekke | A63B 60/46 |
| 2017/0348560 | A1* | 12/2017 | Ishikawa | A61B 5/7246 |
| 2018/0333992 | A1 | 11/2018 | Gayton | |

FOREIGN PATENT DOCUMENTS

| | | |
|---|---|---|
| JP | 2015-073821 | 4/2015 |
| JP | 2017-086210 | 5/2017 |
| WO | WO 2012/004285 | 1/2012 |
| WO | WO 2016/000854 | 1/2016 |
| WO | WO 2016/084985 | 6/2016 |

OTHER PUBLICATIONS

European Search Report for European Application No. 18813360.7 dated Dec. 21, 2020, 9 pages, Germany.

* cited by examiner (A) HALFWAY BACK (B) TOP

| | SP ANGLE | AD ANGLE |
|---|---|---|
| HALFWAY BACK | 9.1 | 0.9 |
| TOP | 33.4 | 2.8 |

FIG. 13

SWING MEASUREMENT DEVICE, SWING MEASUREMENT METHOD, AND SWING MEASUREMENT PROGRAM

TECHNICAL FIELD

The present technology relates to a swing measurement device, a swing measurement method, and a swing measurement program, which measure an evaluation index of a swing of a golf club using an inertial sensor.

BACKGROUND ART

Conventionally, as an evaluation index of a swing of a golf club, techniques for measuring how an orientation of a face surface behave during a swing are known. The orientation of the face surface during a swing is one element that determines the stability of a face surface orientation on impact.

As a method for measuring the face surface orientation during a swing, for example, Japan Unexamined Patent Publication No. 2015-073821 below describes a proposal using an inertial sensor attached to the grip of a golf club and evaluating the change in the orientation of the face surface from address to impact as the amount of change around the shaft axis with respect to the address.

A plane along the trajectory of a golf club (shaft portion) during a swing (hereinafter referred to as a "shaft plane") is known as an evaluation index of a swing of a golf club.

As a method for evaluating the shaft plane, a method for calculating the position of the shaft plane from an image captured using a camera is known; however, there are problems in that the effect of the imaging angle of the camera is large and the accuracy is not good.

In addition, in Japan Unexamined Patent Publication No. 2015-073821 described above, although the relative amount of rotation about the shaft axis is evaluated with respect to the orientation of the face surface, an evaluation that takes the actual shaft plane into consideration is not performed, and there is room for improvement.

SUMMARY

The present technology measures the evaluation index of a swing of a golf club, which takes the shaft plane into consideration.

A swing measurement device according to the technology is a swing measurement device for measuring an evaluation index of a swing of a golf club using an inertial sensor, the swing measurement device including: a movement trajectory calculation unit that calculates a movement trajectory of the golf club during the swing using a detection value of the inertial sensor; a shaft plane calculation unit that calculates a shaft plane in the swing based on the movement trajectory in a freely selectable section during the swing; and an angle calculation unit that calculates a shaft plane angle formed by a face surface of the golf club with respect to the shaft plane as the evaluation index.

A swing measurement device according to the technology is provided in which the shaft plane calculation unit calculates the shaft plane based on the movement trajectory in a freely selectable section from an address position to an apex position of the swing, the apex position being a point at which a head of the golf club has reached a highest position during a back swing.

A swing measurement device according to the technology is provided in which the shaft plane calculation unit calculates the shaft plane based on the movement trajectory from a halfway back position to the apex position during the back swing.

A swing measurement device according to the technology is provided in which the shaft plane calculation unit calculates the shaft plane based on the movement trajectory from the address position to a halfway back position during the back swing.

A swing measurement method according to the technology is a swing measurement method for measuring an evaluation index of a swing of a golf club using an inertial sensor, the swing measurement method including the steps of: movement trajectory calculating of calculating a movement trajectory the golf club during the swing using a detection value of the inertial sensor; shaft plane calculating of calculating a shaft plane in the swing based on the movement trajectory in a freely selectable section during the swing; and angle calculating of calculating a shaft plane angle formed by a face surface of the golf club with respect to the shaft plane as the evaluation index.

A swing measurement method according to the technology is provided in which in the shaft plane calculating, the shaft plane is calculated based on the movement trajectory in a freely selectable section from the address position to the apex position of the swing, the apex position being a point at which the head of the golf club has reached the highest position during a back swing.

The swing measurement method according to the technology is provided in which in the shaft plane calculating, the shaft plane is calculated based on the movement trajectory from the halfway back position to the apex position during the back swing.

The swing measurement method according to the technology is provided in which in the shaft plane calculating, the shaft plane is calculated based on the movement trajectory from the address position to the halfway back position during the back swing.

A swing measurement program according to the technology is provided in which the swing measurement program is configured to cause a computer to execute the swing measurement method.

According to the technology, the shaft plane angle formed by the face surface of the golf club with respect to the shaft plane is calculated, which is advantageous in understanding the swing type of each measurer. In addition, it is also advantageous to make an evaluation that is tailored to the swing type of each measurer.

According to the technology, the shaft plane is calculated based on the movement trajectory in the section from the address position to the apex position (the apex position in the back swing), so it is possible to exclude the movement trajectory from the apex position beyond the head of the measurer to the top position, which is advantageous in improving the calculation accuracy of the shaft plane.

According to the technology, the shaft plane is calculated based on the movement trajectory from the halfway back position to the apex position, so the shaft plane can be calculated based mainly on the movement trajectory in the second half of the back swing. In addition, the shaft plane is calculated using only about half of the movement trajectory data during the back swing, which is advantageous in reducing the processing load on the device.

According to the technology, the shaft plane is calculated based on the movement trajectory from the address position to the halfway back position, so the shaft plane can be calculated based mainly on the movement trajectory in the first half of the back swing. In addition, the shaft plane is calculated using only about half of the movement trajectory data during the back swing, which is advantageous in reducing the processing load on the device.

According to the technology, a swing measurement method can be executed using a computer.

BRIEF DESCRIPTION OF DRAWINGS

FIG. 13 is a table illustrating a comparison between the shaft plane angle and an address angle.

DETAILED DESCRIPTION

In the following, preferred embodiments of a swing measurement device, a swing measuring method, and a swing measuring program according to the present technology will be described in detail with reference to the accompanying drawings.

Figure 1:
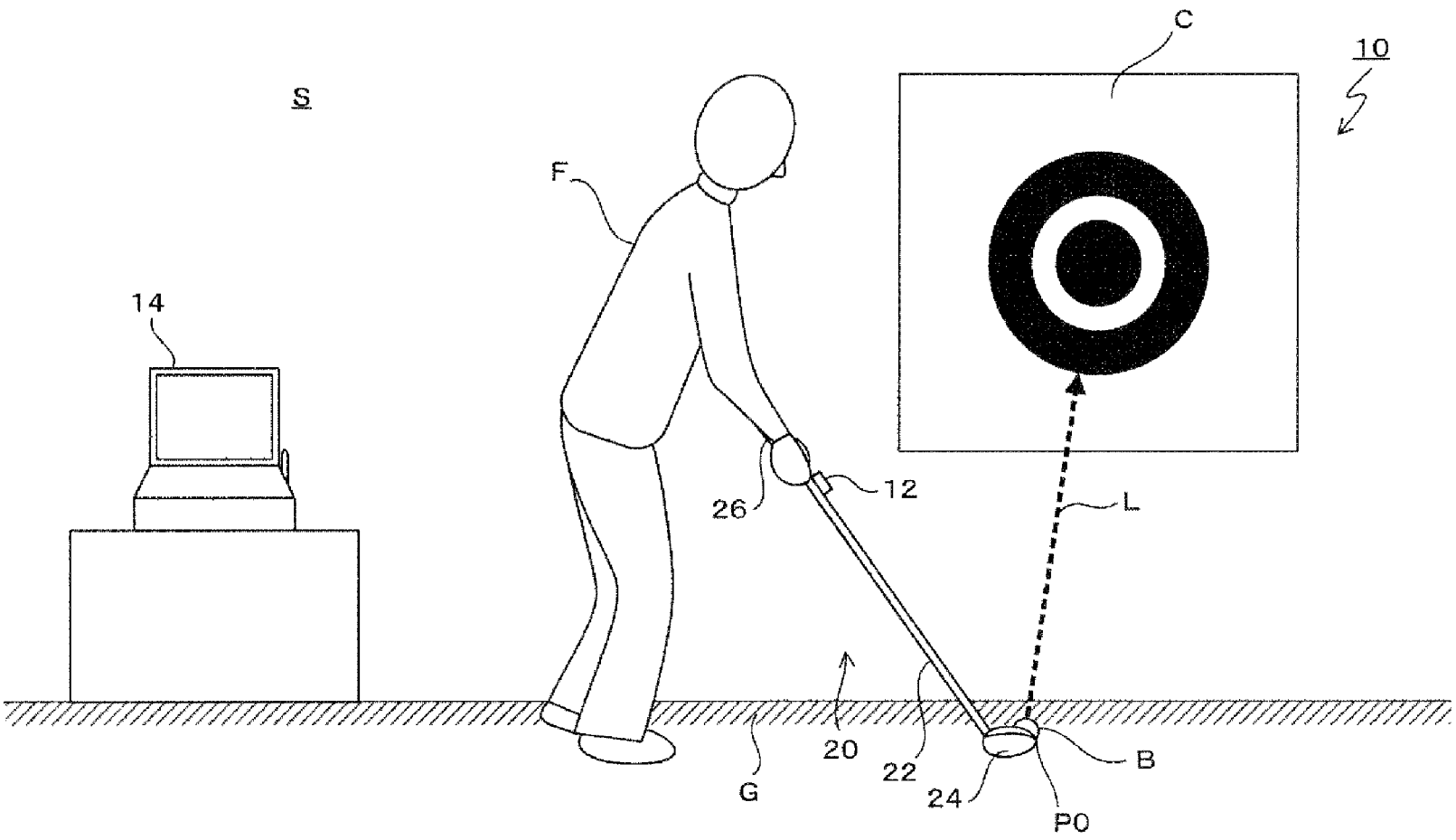
FIG. 1 is an explanatory diagram illustrating a configuration of a swing measurement system 10 according to an embodiment.

FIG. 1 is an explanatory diagram illustrating a configuration of a swing measurement system 10 according to an embodiment.

The swing measurement system 10 is configured by an inertial sensor 12 and a computer 14 (swing measurement device), wherein the computer 14 calculates how a golf club 20 behaves inside a measurement space S, based on the measurement results of the inertial sensor 12, and calculates an evaluation index of a swing.

The golf club 20 includes a large shaft 22, a golf club head 24, and a grip 26. The golf club head 24 is provided at one end portion of the shaft 22 and the grip 26 is provided at the other end portion.

A ball placement position P0 for placing a golf ball B is predetermined on a ground G of the measurement space S, and the ball placement position P0 is indicated by a mark or the like provided on the ground G. Alternatively, a tee is provided at the ball placement position P0, and the golf ball B is placed on this tee.

Furthermore, a target C is provided in front of the ball placement position P0 as a target for launching the golf ball B. Note that, while the ball placement position P0 and the target C are depicted in close proximity to each other in the drawings, the ball placement position P0 and target C actually have a predetermined distance (a distance corresponding to the carrying distance of a club being used, such as a driver or the like).

A measurer F swings the golf club 20, whereby the face surface of the golf club head 24 launches the golf ball B placed on the ball placement position P0 toward the target C.

The acceleration and angular velocity at the time of this swing are measured by the inertial sensor 12, and as a result of a computational process by the computer 14, an evaluation index of a swing is calculated.

Note that a straight line connecting a center point P1 of the golf ball B placed on the ball placement position P0 and the target C is a target line L.

Reference coordinates centered at the ball placement position P0 are set in the measurement space S.

Figure 2:
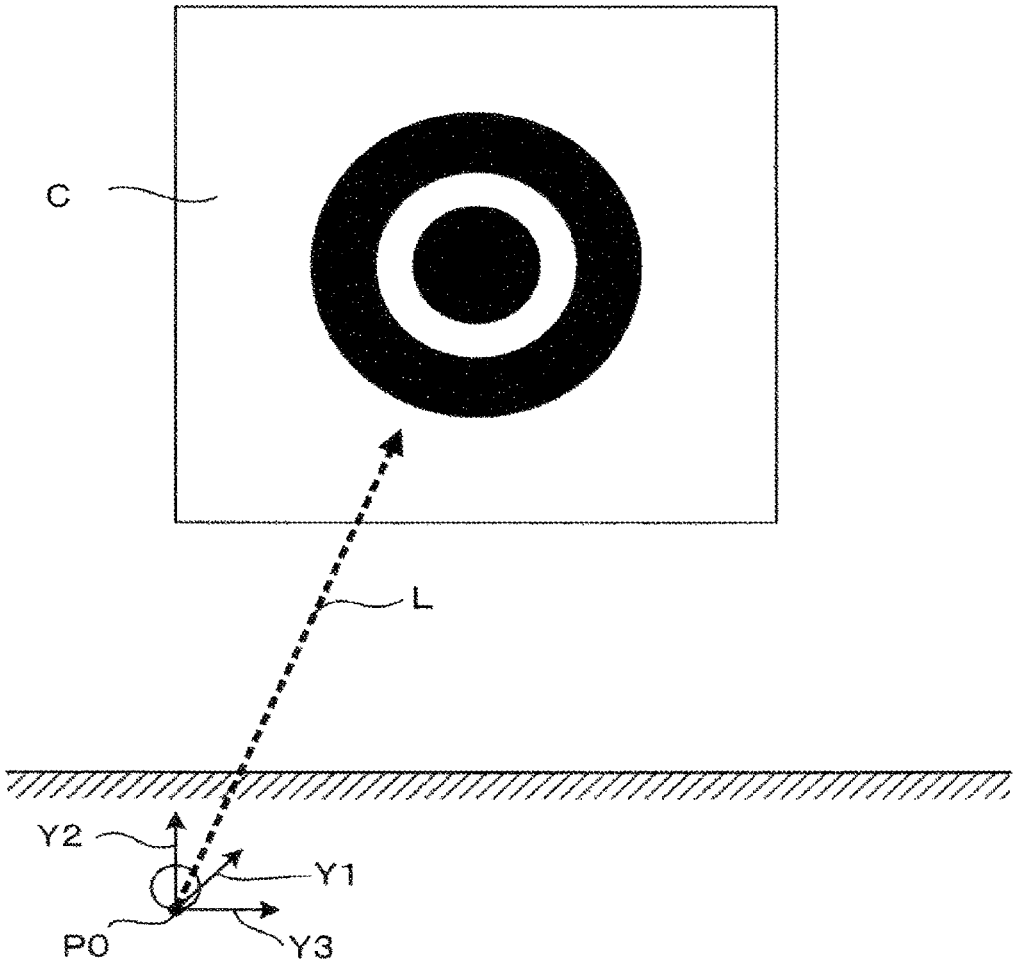
FIG. 2 is an explanatory diagram of reference coordinates in a measurement space S.

FIG. 2 is an explanatory diagram of the reference coordinates in the measurement space S.

The reference coordinates of the measurement space S are centered at the ball placement position P0 and specified by a first axis Y1 obtained by projecting the target line L on the ground G; a second axis Y2 perpendicular to the ground G; and a third axis Y3 being level to the ground G and extending in a direction perpendicular to the plane formed by the first axis Y1 and the second axis Y2.

A freely selectable location in the measurement space S may be identified using reference coordinates specified by from the first axis Y1 to the third axis Y3.

Figure 3A:
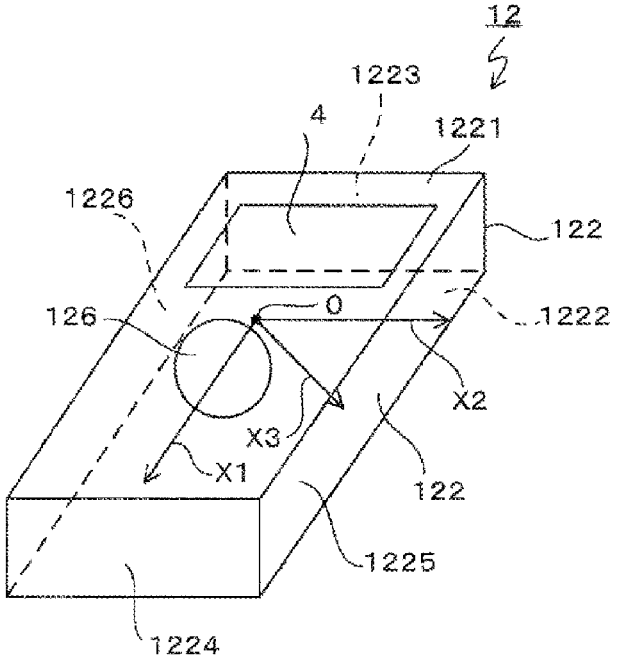
FIGS. 3A and 3B are diagrams illustrating the appearance of an inertial sensor 12.
Figure 3B:
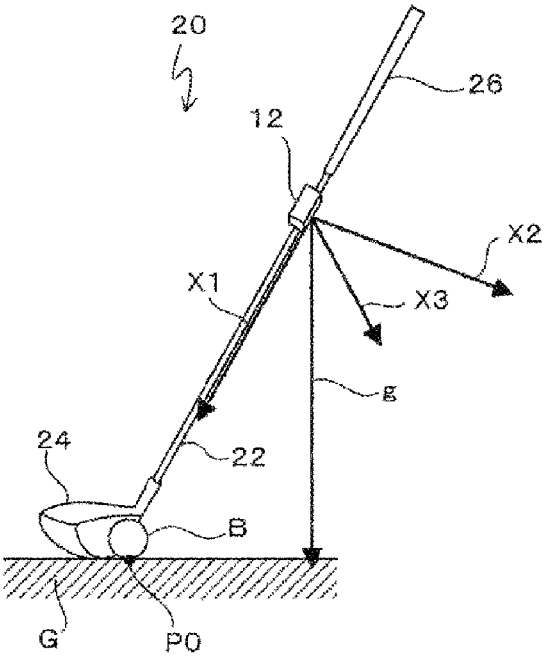

FIGS. 3A and 3B are diagrams illustrating the visual appearance of the inertial sensor 12.

FIG. 3A is a perspective view of the inertial sensor 12, and FIG. 3B is a diagram illustrating the state of the inertial sensor 12 being attached to the golf club 20.

The inertial sensor 12 is a compact sensor unit having a wireless communication function. The sampling frequency of the inertial sensor 12 is, for example, from 500 Hz to 1000 Hz and has a time resolution several times larger than the sampling frequency of an existing magnetic sensor (for example, 240 Hz). Moreover, existing magnetic sensors are wired; however, the inertial sensor 12 is able to transmit measurement results in a wireless manner to the computer 14.

The inertial sensor 12 includes a housing 122, a display unit 124, and an operation button 126.

As illustrated in FIG. 3A, the housing 122 of the inertial sensor 12 includes a front surface 1221, a rear surface 1222, an upper surface 1223, a lower surface 1224, a right side surface 1225, and a left side surface 1226 and has a rectangular plate shape, with a thickness being in a front-rear direction, a width in a left-right direction having a larger dimension than the thickness, a length in an up-down direction having a larger dimension than the width.

The front surface 1221 of the housing 122 has a substantially rectangular shape in which a longitudinal direction is parallel to the up-down direction of the housing 122.

The display unit 124 and the operation button 126 are provided on the front surface 1221.

The display unit 124 is a liquid crystal monitor or the like, and displays a measurement state (display such as "Measurement in Progress"), measurement results, and the like from the inertial sensor 12.

Note that the display unit 124 may be omitted, and for example, the measurement state or the like of the inertial sensor may be made visible by the presence or absence of a light such as LED (Light Emitting Diode); or a light color.

The operation button 126 receives instruction input for instructing a start and an end of measurement by the inertial sensor 12.

Note that the operation button 126 may be omitted, and the instruction input for instructing the start and the end of measurement may be provided externally (for example, by the computer 14).

A fixing portion (not illustrated) for attaching the housing 122 to the golf club 20 is provided on the rear surface 1222 opposing the front surface 1221.

The inertial sensor 12 measures in real time the acceleration and angular velocity of the measurement point in three-dimensional orthogonal coordinates.

In the present embodiment, the three-dimensional orthogonal coordinates for measurement by the inertial sensor 12 are set with the center point of the housing 122 as a measurement point O, the measurement point O being an origin. More specifically, from the measurement point O, a first axis X1 is set in a direction of the lower surface 1224 of the housing 122, a second axis X2 is set in a direction of the right side surface 1225, and a third axis X3 is set in a direction of the rear surface 1222.

When attaching the inertial sensor 12 to the golf club 20, the first axis X1 is, for example, aligned with an axial direction of the golf club 20, or in other words, the shaft 22. Also, the third axis X3 is aligned in a direction parallel to the face surface of the golf club 20.

Note that the inclination of the golf club 20 from the ground G (in the first axis X direction) may be measured by identifying the gravitational direction g using the inertial sensor 12.

Here, in the initial position of the swing (at the start of measurement), a state in which the golf club 20 is held such that the second axis X2 of the inertial sensor 12 coincides with the first axis Y1 of the measurement space S (the projection line of the target line L onto the ground G) is referred to as the "reference state of the golf club".

By holding the golf club 20 in the reference state, a corresponding relationship can be specified between the reference coordinates in the measurement space S and the three-dimensional orthogonal coordinates for measurement of the inertial sensor 12, and the direction measured by the inertial sensor 12 can be expressed by the relative positional relationship with respect to the measurement space S.

Furthermore, supposing a case where the golf club 20 is shifted from the reference state, when the amount of deviation between the reference coordinates in the measurement space S and the three-dimensional orthogonal coordinates for measurement of the inertial sensor 12 is known, it is possible to calibrate the measurement result of the inertial sensor 12.

Figure 4:
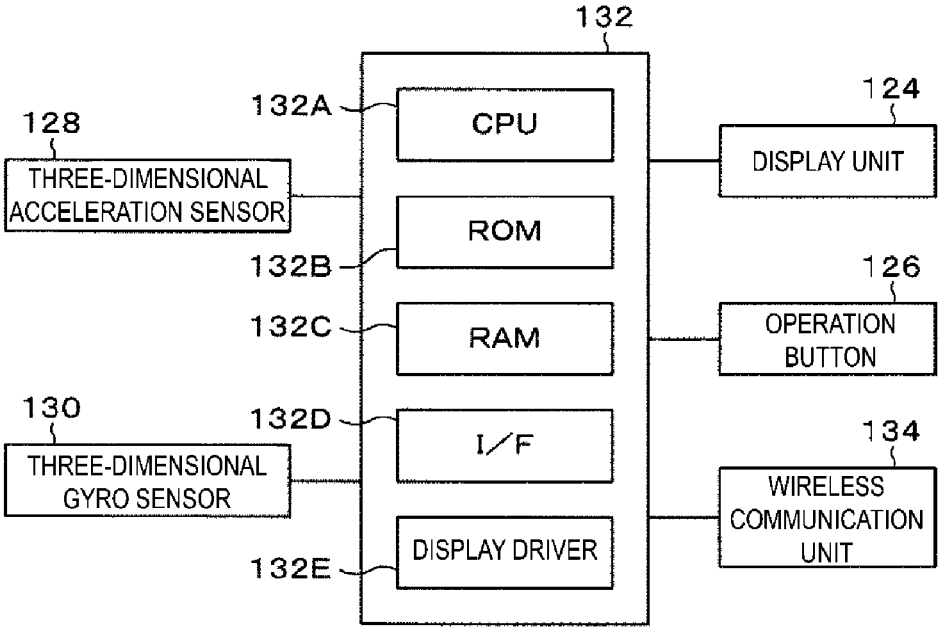
FIG. 4 is a block diagram illustrating a configuration of the inertial sensor 12.

FIG. 4 is a block diagram illustrating the configuration of the inertial sensor 12.

In addition to the display unit 124 and the operation button 126, the inertial sensor 12 is configured to include a three-dimensional acceleration sensor 128, a three-dimensional gyro sensor 130, a processing unit 132, a wireless communication unit 134, and the like.

The three-dimensional acceleration sensor 128 measures acceleration in the direction of each axis (X1, X2, X3 above) of the three-dimensional orthogonal coordinates at the measurement point O.

The three-dimensional gyros sensor 130 measures angular velocity around each axis (X1, X2, X3 above) of the three-dimensional orthogonal coordinates at the measurement point O.

The wireless communication unit 134 transmits the measurement data of the three-dimensional acceleration sensor 128 and the three-dimensional gyro sensor 130 to the computer 14.

The processing unit 132 controls activating the inertial sensor 12; applying a time stamp to the measurement data; transmitting the measurement data; and the like.

In the present embodiment, the processing unit 132 is configured by a microcomputer.

The processing unit 132 includes a CPU (Central Processing Unit) 132A; and a ROM (Read Only Memory) 132B, a RAM (Random Access Memory) 132C, an interface 132D, a display driver 132E, and the like connected via an interface circuit and a bus line (not illustrated).

The ROM 132B stores a control program that is executed by the CPU 132A for calculating the movement direction and movement velocity of the moving body, and the RAM 132C provides a working area.

The interface 132D inputs and provides the measurement values of the three-dimensional acceleration sensor 128 and the three-dimensional gyro sensor 130 to the CPU 132A and also receives and provides an operation signal from the operation button 126 to the CPU 132A.

The display driver 132E drives the display unit 124 based on control by the CPU 132A.

Next, a configuration of the computer 14 will be described.

Figure 5:
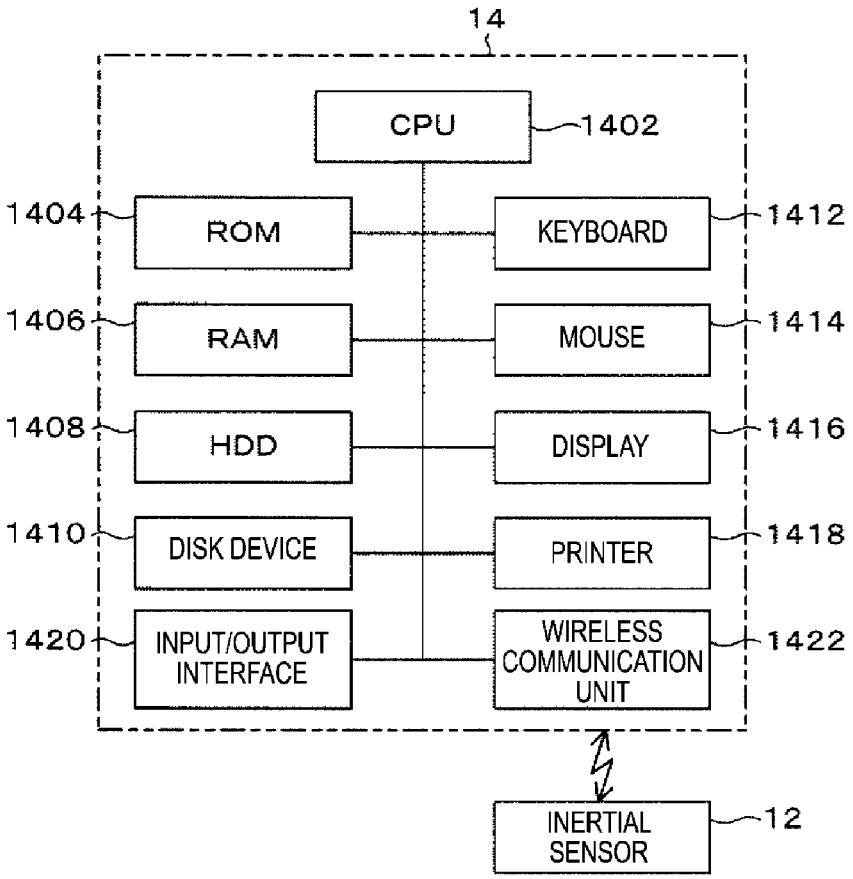
FIG. 5 is a block diagram illustrating a configuration of a computer 14.

FIG. 5 is a block diagram illustrating a configuration of the computer 14.

The computer 14 includes a CPU 1402; and a ROM 1404, a RAM 1406, a hard disk device 1408, a disk device 1410, a keyboard 1412, a mouse 1414, a display 1416, a printer 1418, an input/output interface 1420, a wireless communication unit 1422 and the like that are connected via an interface circuit and a bus line (not illustrated).

The ROM 1404 stores a control program and the like, and the RAM 1406 provides a working area.

The hard disk device 1408 stores an evaluation index calculation program that calculates how the golf club 20 behaves in the measurement space S, based on the measurement result of the inertial sensor 12, and that calculates the evaluation index of the swing, based on the behavior of the golf club 20. In addition, the hard disk device 1408 stores a three-dimensional shape model in which the golf club 20 is reproduced in a three-dimensional coordinate system.

The disk device 1410 records and/or reproduces data on a recording medium such as CD (Compact Disc), DVD (Digital Video Disc), and the like.

The keyboard 1412 and the mouse 1414 receive operation input that is input by the operator.

The display 1416 is for displaying and outputting data such as, for example, the evaluation index or the like, and the printer 1418 is for printing out the data, and the data is output by the display 1416 and the printer 1418.

The input/output interface 1420 is for transmitting data to and from an external device.

The wireless communication unit 1422 is for exchanging data (measurement data and the like) with the inertial sensor 12, using wireless communication.

Note that in the present embodiment, the computer 14 is used as a device for calculating the evaluation index of a swing based on the measurement result of the inertial sensor 12; however, for example, the evaluation index may also be calculated using a compact information processing device such as a smartphone, a tablet, or the like.

In addition, a function for calculating the evaluation index may be installed in the inertial sensor 12, for example. In this case, the calculated evaluation index may be displayed on the display unit 124 of the inertial sensor 12 or may be transmitted to another information processing device and be output as a display or the like.

Figure 6:
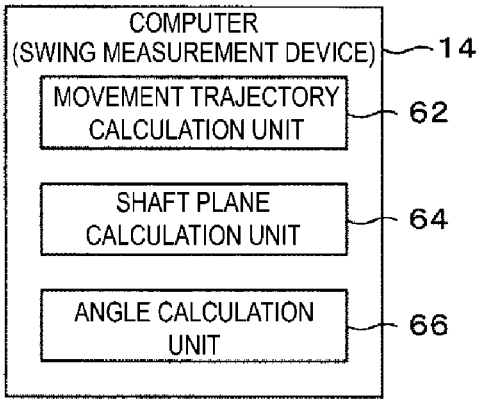
FIG. 6 is a block diagram illustrating a functional configuration of the computer 14.

FIG. 6 is a block diagram illustrating a functional configuration of the computer 14.

The computer 14 functions as a swing measurement device that, based on the measurement result of the inertial sensor 12, computes the behavior of the golf club 20 in the measurement space S and calculates the evaluation index for the swing.

The computer 14, by the CPU 1402 executing the above-described evaluation index calculation program, functions as a movement trajectory calculation unit 62, a shaft plane calculation unit 64, and an angle calculation unit 66.

The movement trajectory calculation unit 62, using the detection value of the inertial sensor 12, calculates the movement trajectory of the golf club 20 during the swing.

The shaft plane calculator 64, based on the movement trajectory in a freely selectable section during the swing, calculates the shaft plane in that swing.

The angle calculation unit 66 calculates the relative shaft plane angle formed by the face surface of the golf club 20 with respect to the shaft plane as an evaluation index.

Next, details of each of the above-described functional units will be described.

As described above, the inertial sensor 12 is attached to the golf club 20; however, since the shape of the golf club 20 is known and substantially constant (the bending at the time of impact may be ignored), as long as the measurement point of the inertial sensor 12 is fixed, a relative position between a freely selectable point on the golf club 20 and the measurement point can be specified.

The evaluation index calculation program calculates the position of each point of the golf club 20 at each time, based on the measurement result of inertial sensor 12, and reproduces the behavior of the golf club 20 during the swing in the virtual space of the RAM 1406. Various evaluation indexes for the swing are then calculated.

In the present embodiment, the following evaluation indexes are calculated by the evaluation index calculation program.

Figure 7A:
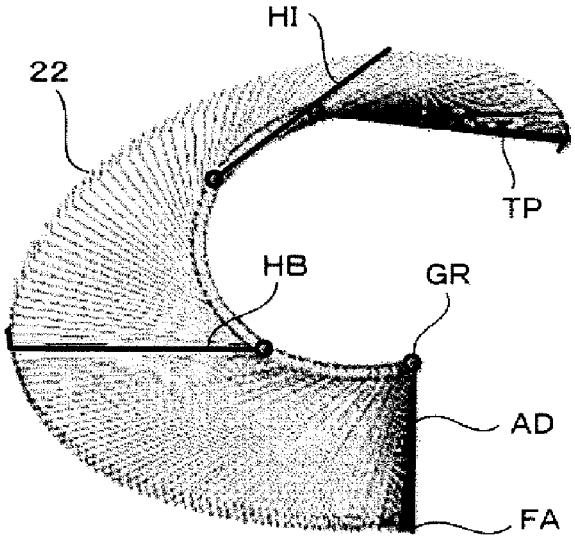
FIGS. 7A and 7B are explanatory diagrams of a movement trajectory of a golf club 20.
Figure 7B:
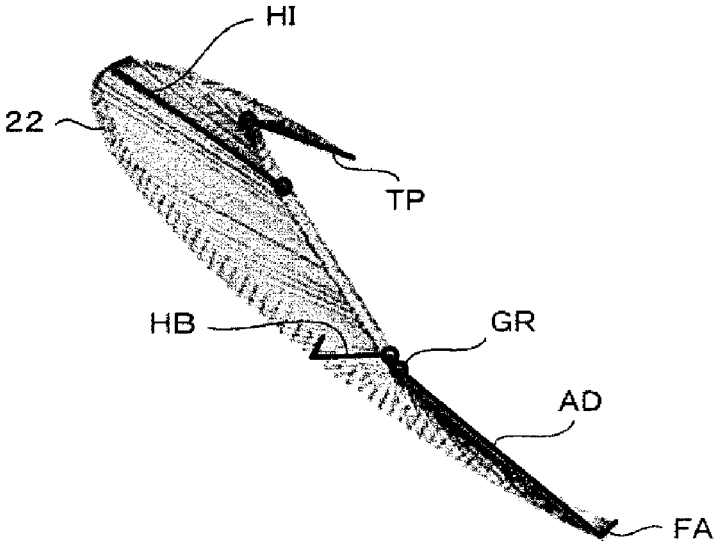
Figure 15:
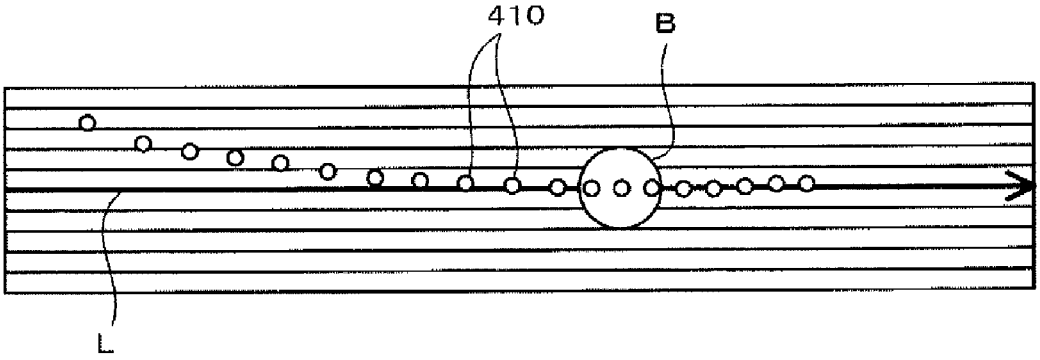
FIG. 15 is an explanatory diagram of a trajectory of movement of the golf club 20.

(1) The movement trajectory data as time series data indicating the movement trajectory of the golf club 20 (movement trajectory calculation unit 62):

As illustrated in FIGS. 7A and 7B, the movement trajectory data is indicated by the movement trajectory of the shaft 22 of the golf club 20. Note that, as another form of movement trajectory data, the movement trajectory of the center point of the face surface of the golf club 20 such as that illustrated in FIG. 15 may also be calculated.

Note that FIG. 7A is a movement trajectory viewed from the front of the measurer F, and FIG. 7B is a movement trajectory viewed from the direction opposite the extending direction of the target line L.

Of the movement trajectory data of FIGS. 7A and 7B, GR indicates the trajectory of the grip position, and FA indicates the trajectory of the head position (face surface direction). Also, of the series of movement trajectories, AD indicates the address position, HB indicates the halfway back position, HI indicates the apex position at which the golf club head 24 has reached the highest position during the back swing, and TP indicates the top position at which the direction of movement of the golf club head 24 is reversed (switching point).

(2) The shaft plane, which is a plane along a trajectory of the golf club 20 during a swing (shaft plane calculation unit 64):

Using the movement trajectory of the golf club 20 in a freely selectable section during the swing, and by using a publicly known method such as a least squares method or the like, the shaft plane is calculated as the plane in which the distance to each of these lines (movement trajectories) is minimized.

The section to be extracted during the shaft plane calculation is, for example, a freely selectable section from the address position AD (refer to FIGS. 7A and 7B) to the apex position HI (refer to FIGS. 7A and 7B). In other words, in this case, the shaft plane calculation unit 64 calculates the shaft plane based on the movement trajectory in a freely selectable section from the address position AD to the apex position HI of the swing, the point at which the golf club head 24 reaches the highest position during the back swing being defined as the apex position HI.

In this way, the movement trajectory from the address position AD to the apex position HI is used to calculate the shaft plane, and by excluding the movement trajectory from the apex position HI to the top position TP, the calculation accuracy of the shaft plane may be improved. In particular, in a case of a measurer, the section of which from the apex position HI to the top position TP is long, the movement trajectory of this section is often not on the same plane as the main back swing section (address position AD to apex position HI), and therefore, it is considered appropriate to use the movement trajectory from the address position AD to the apex position HI for the calculation of the shaft plane.

Figure 8A:
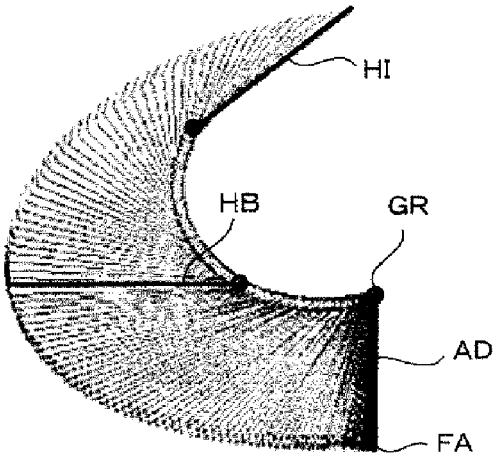
FIGS. 8A and 8B are explanatory diagrams of a movement trajectory of the golf club 20.
Figure 8B:
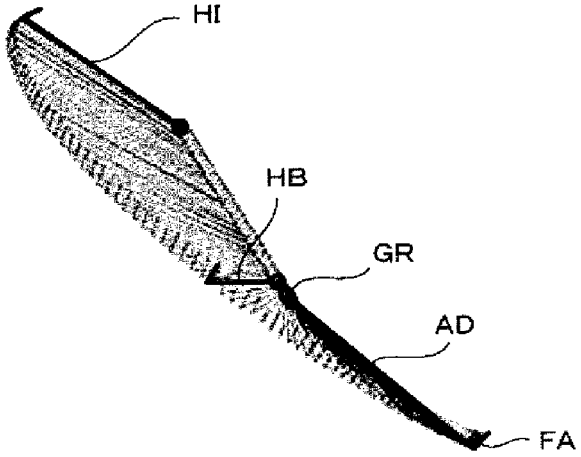

For example, FIGS. 8A and 8B illustrate the result of extracting the section from the address position AD to the apex position HI from the movement trajectory of the entire swing illustrated in FIGS. 7A and 7B. Note that FIG. 8A is a movement trajectory as seen from the front of the measurer F, and FIG. 8B is a movement trajectory as seen from the direction opposite the extension direction of the target line L.

Figure 9:
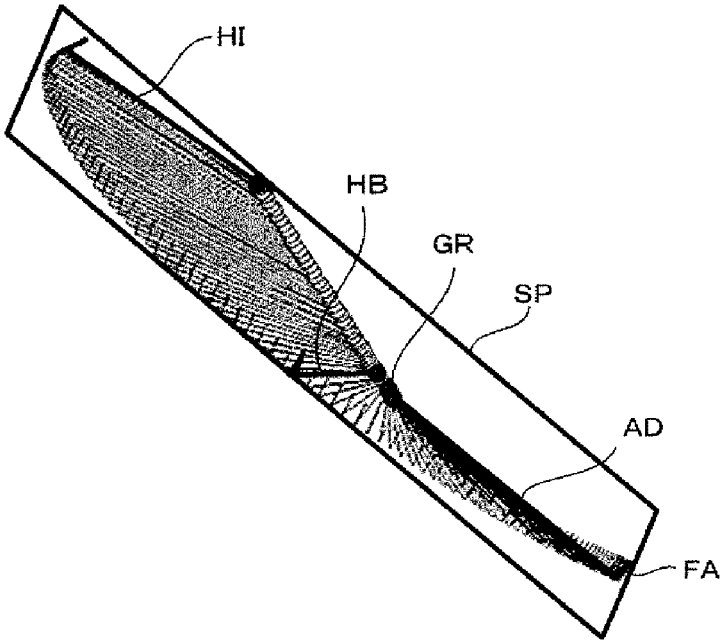
FIG. 9 is an explanatory diagram of a shaft plane calculated using the movement trajectory of FIGS. 8A and 8B.

A shaft plane SP illustrated in FIG. 9 is calculated from the movement trajectory in FIGS. 8A and 8B using a least squares method or the like. FIG. 9 illustrates the shaft plane SP superimposed on the movement trajectory as seen from the direction opposite the direction of extension of the target line L of the measurer F (refer to FIG. 8B).

Moreover, a freely selectable section may be extracted from the section from the address position AD to the apex position HI to calculate the shaft plane. The shaft plane can be calculated as long as it is possible to acquire two points of the movement trajectory in the swing.

Figure 10A:
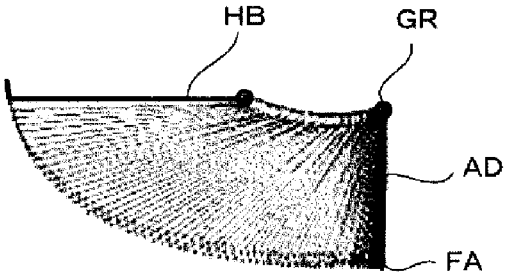
FIGS. 10A and 10B are explanatory diagrams of a movement trajectory of the golf club 20.
Figure 10B:
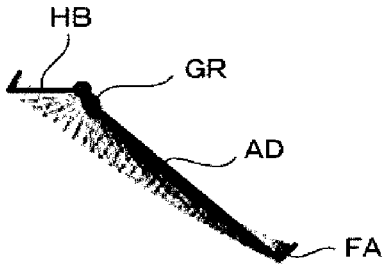

For example, the shaft plane may be calculated based on the movement trajectory from the address position AD to the halfway back position HB during the back swing (refer to FIGS. 10A and 10B). In this case, it is possible to calculate the shaft plane based mainly on the movement trajectory of the first half of the back swing. FIGS. 10A and 10B illustrate an extracted movement trajectory from the address position AD to the halfway back position HB.

Note that the halfway back position HB is generally specified as a point where the shaft is parallel to the ground or a point where the wrist is raised to the waist; however, in the process by the program, it is considered that the accuracy is higher in the case of the former, or in other words, the point where the shaft is parallel to the ground.

Also, although not illustrated, the shaft plane may be calculated based on the movement trajectory from the halfway back position HB to the apex position HI during the back swing. In this case, it is possible to calculate the shaft plane based mainly on the movement trajectory in the second half of the back swing.

In this way, by extracting a freely selectable section from the section from the address position AD to the apex position HI and calculating the shaft plane, the processing load on the computer 14 may be reduced.

(3) The shaft plane angle formed by the face surface of the golf club 20 with respect to the shaft plane (angle calculation unit 66):

The shaft plane angle can be calculated from the face surface orientation at each time during the swing and the shaft plane calculated in (2). At this time, the shaft plane angle can be calculated as time series data at each time during the swing, and only the shaft plane angle at a freely selectable time can be calculated (or extracted from the time series data).

Figure 11A:
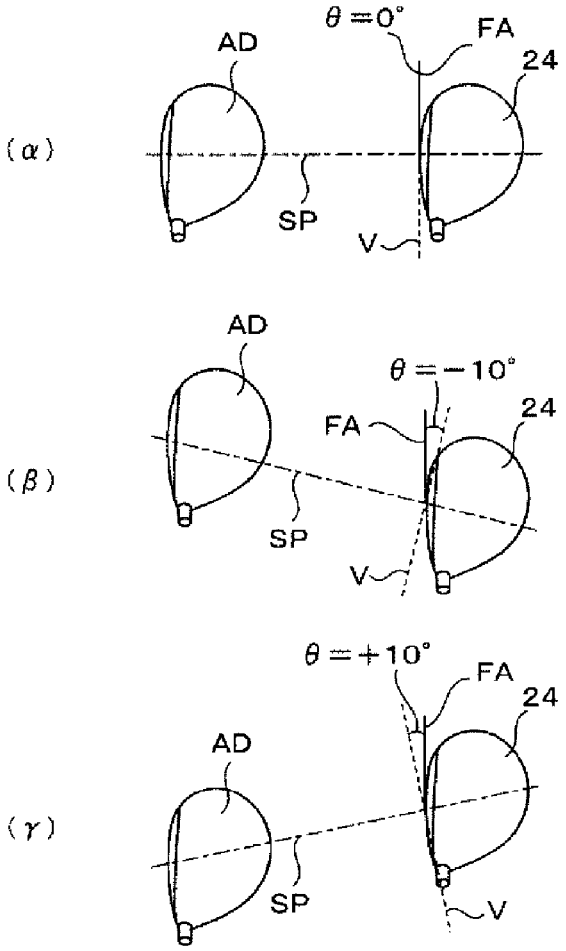
FIGS. 11A and 11B are explanatory diagrams illustrating an example of a shaft plane angle.

FIG. 11A is an explanatory diagram illustrating an example of a shaft plane angle.

In FIG. 11A, reference sign AD is the address position, FA is the face surface orientation of the golf club head 24 at a specified time, SP is the shaft plane, and V is a line segment orthogonal to the shaft plane. In this embodiment, the shaft plane angle is an angle formed by the face surface orientation FA, with the line segment V orthogonal to the shaft plane SP as a reference (0°) and takes a positive angle clockwise.

For example, in the state α, the line segment V and the face surface orientation FA coincide, and the shaft plane angle is 0°. In state β, the angle between the line segment V and the face surface orientation FA or, in other words, the shaft plane angle, is −10°. In state γ, the angle between the line segment V and the face surface orientation FA or, in other words, the shaft plane angle, is +10°.

Figure 11B:
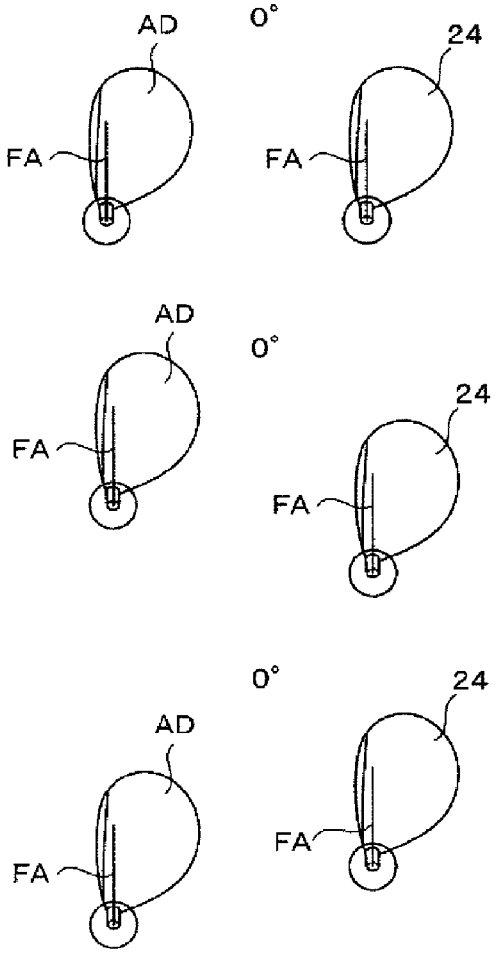

FIG. 11B illustrates the result of a change in a face angle about the shaft axis with respect to the face surface orientation FA in the address position AD as a comparative example.

The position of the golf club head 24 in the states α, β, γ in FIG. 11B is in the same position as in the states α, β, γ in FIG. 11A; however, compared to the face surface orientation FA in the address position AD as in the related art, all of the face angles are 0°, which is different from the shaft plane angles illustrated in FIG. 11A.

Figure 12A:
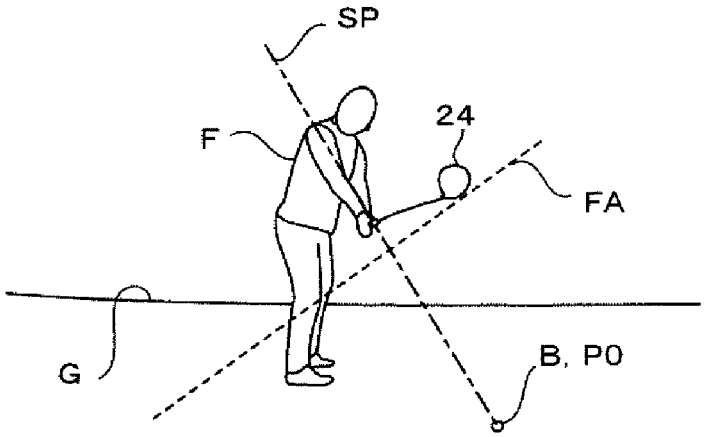
FIGS. 12A and 12B are explanatory diagrams illustrating a measurer F during a swing.
Figure 12B:
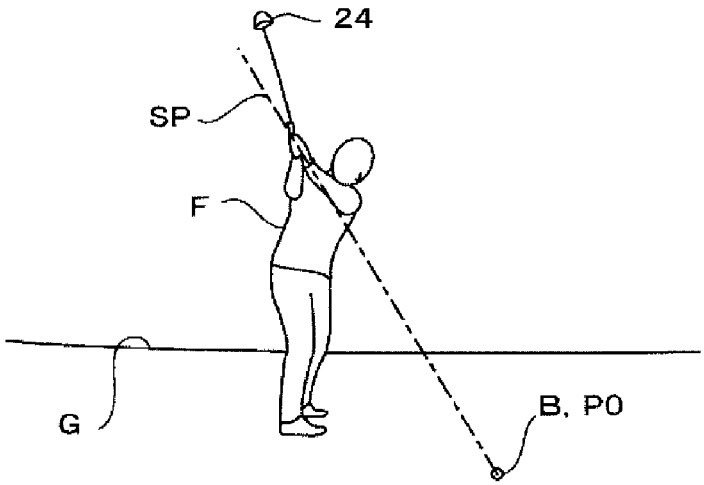

FIGS. 12A and 12B are diagrams of the measurer F during a swing as viewed from the rear (direction opposite the extension direction of the target line L). FIG. 12A is the timing at which the golf club head 24 is in the halfway back position HB, and FIG. 12B is the timing at which the golf club head 24 is in the top position TP.

For such identical swings, when the shaft plane (SP) angle calculated in the present technology; and the face angle (AD angle) by comparison with the face surface orientation FA at the address position AD are each calculated, the result becomes as in the table in FIG. 13.

In other words, in the halfway back position HB, the shaft plane angle was 9.1° and the address angle was 0.9°. Moreover, in the top position TP, the shaft plane angle was 33.4° and the address angle was 2.8°.

As a result, for the address angle there is almost no difference in the face from the address to the top; however, the shaft plane angle greatly increases toward the top, and it can be seen that it is possible to evaluate a swing from a different point of view than the address angle used in the related art as an index for evaluating the swing.

Note that in addition to (1) to (3) above, various evaluation indexes measured by a general swing measurement device as described below may be calculated.

(4) Head speed data based on movement trajectory data:

The head speed during the swing is calculated based on the distance that a center point 410 (refer to FIG. 15) of the face surface of the golf club 20 moves per unit time.

Figure 16:
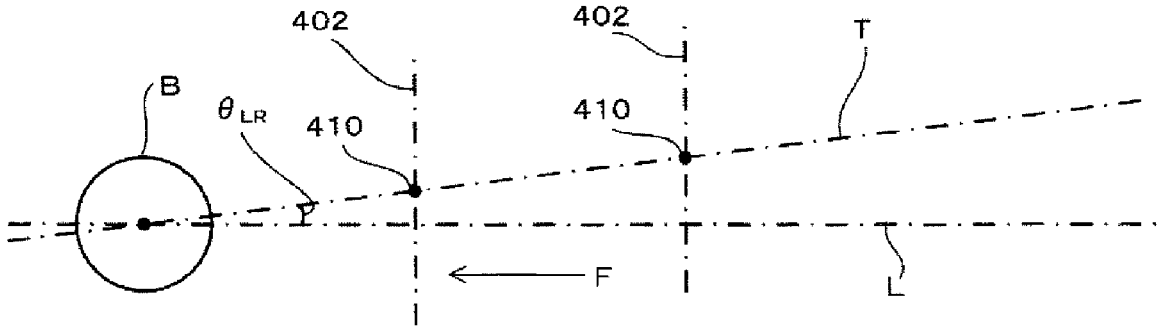
FIG. 16 is an explanatory diagram of a left-right approach angle $\theta_{LR}$.

(5) Left-right approach angle $\theta_{LR}$:

As illustrated in FIG. 16, the left-right approach angle $\theta_{LR}$ refers to the angle formed by the movement trajectory T and the target line L on a horizontal plane when the movement trajectory T of the center point 410 of a face surface 402 of the golf club 20 and the target line L are projected on the horizontal plane. Note that in the drawings, arrow F indicates the direction of movement of the golf club head 24.

Figure 17:
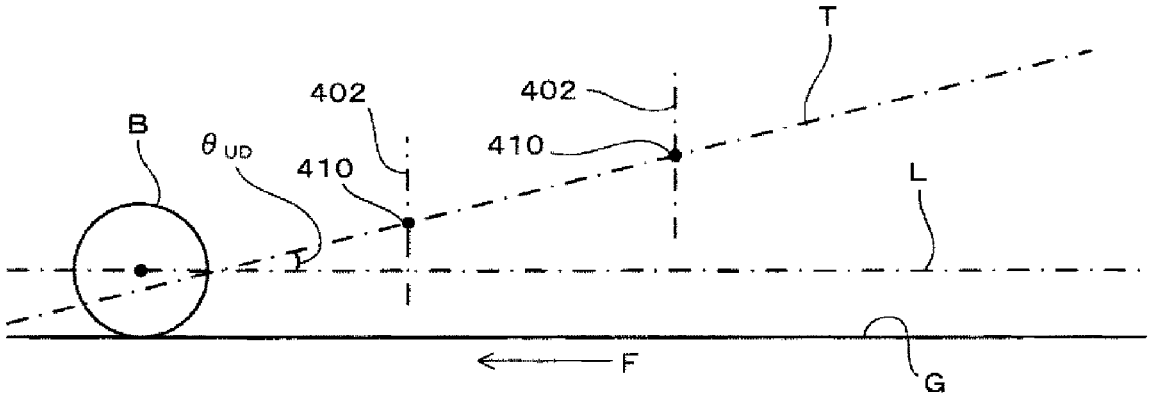
FIG. 17 is an explanatory diagram of an up-down approach angle $\theta_{UD}$.

(6) Up-down approach angle $\theta_{UD}$:

As illustrated in FIG. 17, the up-down approach angle $\theta_{UD}$ refers to the angle formed by the movement trajectory T and the target line L on a vertical plane when the movement trajectory T of the center point 410 of the face surface 402 of the golf club 20 and the target line L are projected on the vertical plane parallel to the target line L.

(7) Orientation data Df indicating the orientation of the golf club head 24 just prior to the face surface 402 hitting the golf ball B:

In the present embodiment, the orientation data Df includes a hitting face angle ϕ, a hitting loft angle α, and a hitting lie angle β.

This is described in the following with reference to FIG. 18, FIG. 19, and FIG. 20.

Figure 18:
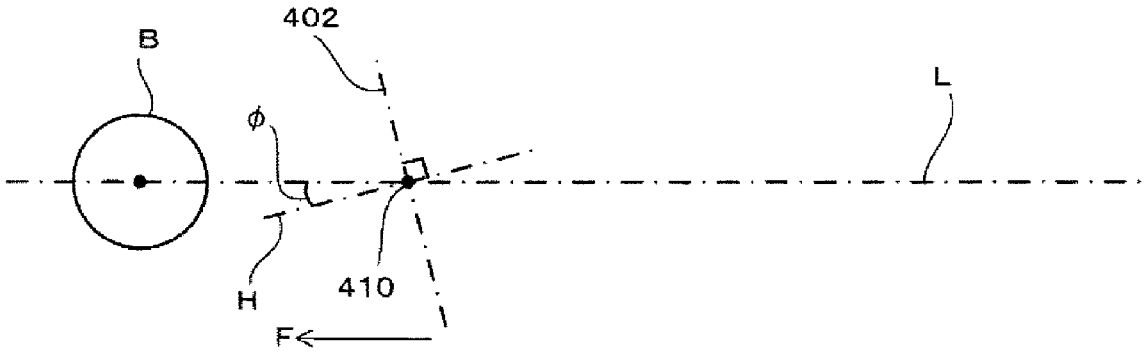
FIG. 18 is an explanatory diagram of a face angle $\phi$ on impact.

(7-1) As illustrated in FIG. 18, when a normal line H passing through the center point 410 of the face surface 402 immediately before the face surface 402 of the golf club 20 hits the golf ball B and the target line L are projected on a horizontal plane, the hitting face angle ϕ is indicated by the angle that is formed between the normal line H and the target L on the horizontal plane.

Figure 19:
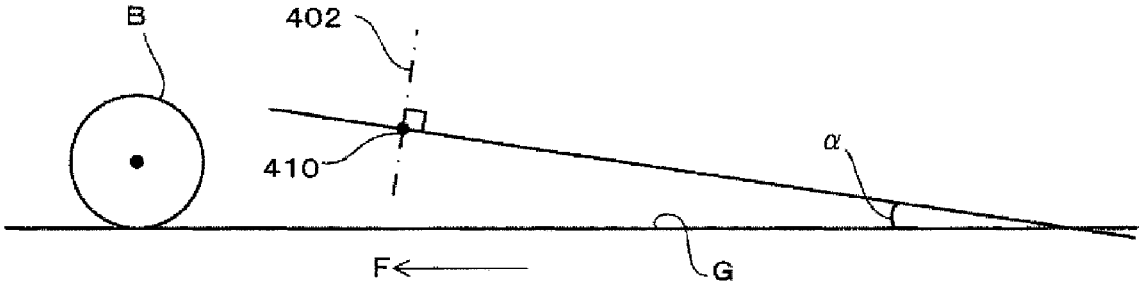
FIG. 19 is an explanatory diagram of a loft angle $\alpha$ on impact.

(7-2) As illustrated in FIG. 19, the hitting loft angle α is indicated by the angle formed by the normal line H passing through the center point 410 of the face surface 402 immediately before the face surface 402 of the golf club 20 hits the golf ball B and a plane parallel to a horizontal plane (ground G) that is crossing the normal line H.

Figure 20:
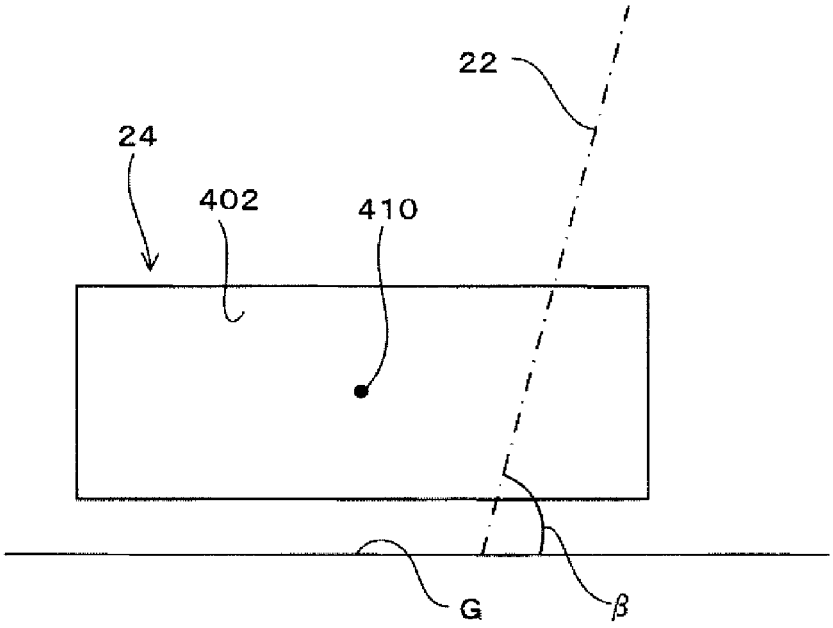
FIG. 20 is an explanatory diagram of a lie angle $\beta$ on impact.

(7-3) As illustrated in FIG. 20, the hitting lie angle β is indicated by the angle formed by the extension line of the shaft 22 immediately before the face surface 402 of the golf club 20 hits the golf ball B and a horizontal plane (ground G in this example) that is crossing the extension line.

Note that the swing evaluation indexes described above are merely examples, and needless to say, only a part of the evaluation indexes described above may be calculated, or an evaluation index other than the evaluation indexes described above may be calculated.

Figure 14:
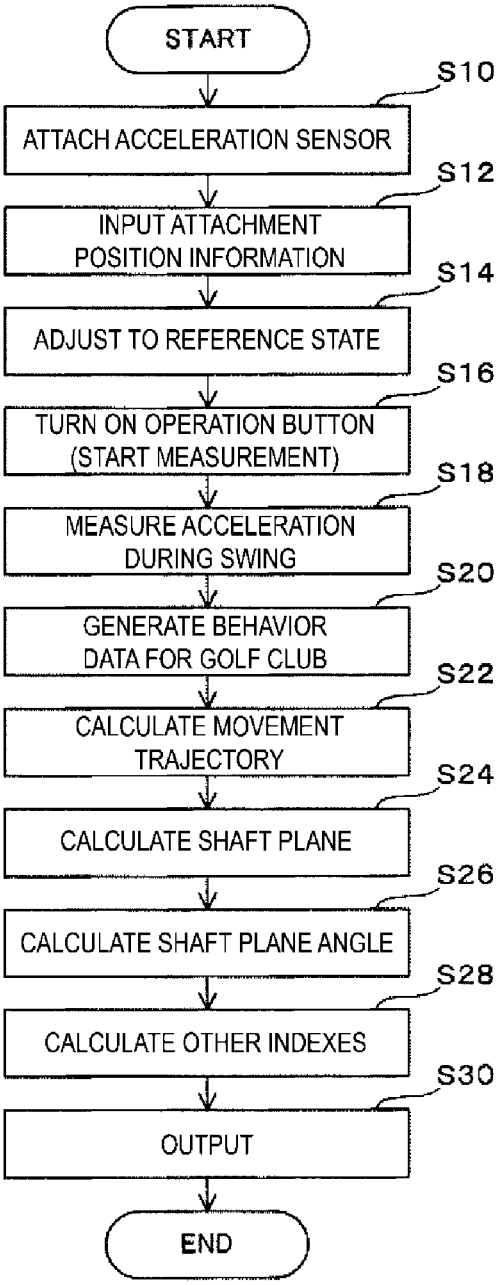
FIG. 14 is a flowchart illustrating the steps of the swing evaluation method of this embodiment.

Next, the swing measurement method according to the present embodiment will be described with reference to the flowchart in FIG. 14.

First, the measurer F attaches the inertial sensor 12 to the golf club 20 (step S10). The attachment position of the inertial sensor 12 is freely selectable; however, a position that does not interfere with the swing by the measurer F is preferable. In the example of FIG. 3B, the inertial sensor 12 is attached near the boundary between the grip 26 and the shaft 22. Also, as described above, when attaching the inertial sensor 12 to the golf club 20, the first axis X1 is aligned with the axial direction of the golf club 20, or in other words, the shaft 22. Moreover, the third axis X3 is aligned in a direction parallel to the face surface of the golf club 20.

Next, the measurer F inputs the attachment position information of the inertial sensor 12 (step S12). The attachment position information is, for example, the distance between a reference point of the inertial sensor 12 after attachment (for example, the center point in the vertical and horizontal directions of the housing 122) and an end portion of the grip 26; the length of the golf club 20; the loft angle; the lie angle; or the like.

Next, the measurer F adjusts the address posture so that the golf club 20 is in the reference state (step S14). In other words, a step of adjusting for adjusting the posture of the golf club 20, which is a hitting tool, to the reference state is performed. In the adjusting of step S14, the position of the golf club 20 is adjusted to the reference state by holding the golf club 20 such that the second axis X2 of the inertial sensor 12 coincides with first axis Y1 of the measurement space S (projection line on the ground G of the target line L).

The golf club 20 is held so that the second axis X2 of the inertial sensor 12 coincides with the first axis Y1 of the measurement space S (projection line on the ground G of the target line L).

After completion of the adjustment of the address posture, the measurer F turns ON the operation button 126 of the inertial sensor 12 to initiate the measurement (step S16). In other words, the operation button 126 is a signal generator that outputs a trigger signal indicating that the adjustment of the position of golf club 20 has been completed, and the inertial sensor 12 receives the trigger signal and begins measuring acceleration.

The measurer F begins to swing after turning ON the operation button 126. The inertial sensor 12 performs a step of acceleration measuring for measuring the acceleration of the golf club 20 during the swing (step S18). In the acceleration measuring, the magnitude and direction of acceleration applied to the inertial sensor are acquired in a time series. The acquired measurement data is transmitted to the computer 14 using wireless communication.

Next, in the computer 14, the swing evaluation index program generates behavior data indicating the behavior of the golf club 20 based on the time series data of the acceleration measured by the inertial sensor 12 (detected value of the inertial sensor 12) and a three-dimensional shape model of the golf club 20. At this time, the swing evaluation index program generates the behavior data by moving the three-dimensional shape model in the virtual space based on the time series data of the acceleration. The evaluation index of a swing is then calculated based on the behavior data.

More specifically, the movement trajectory of the golf club 20 during the swing is calculated (step S22: step of movement trajectory calculating).

Next, the shaft plane in the swing is calculated based on the movement trajectory in a freely selectable section during the swing (step S24: step of shaft plane calculating).

The shaft plane angle formed by the face surface of the golf club 20 with respect to the shaft plane is calculated (step S26: step of angle calculating).

Moreover, other evaluation indexes such as head speed data or the like are calculated (step S28). Note that the calculation order of these evaluation indexes is freely selectable, and for example, the shaft plane and the shaft plane angle may be calculated after calculating an evaluation index such as the head speed data or the like.

Finally, the computer 14 outputs the calculated indexes to the display 1416 or the like (step S30) and terminates the process according to the flowchart.

As described above, the swing measurement system 10 according to this embodiment calculates the shaft plane angle formed by the face surface of the golf club 20 relative to the shaft plane, which is advantageous in understanding the swing type of each measurer. It is also advantageous to perform an evaluation that is tailored to the swing type of each measurer.

Moreover, since the swing measurement system 10 calculates the shaft plane based on the movement trajectory in the section from the address position AD to the apex position HI, it is possible to exclude the movement trajectory from the apex position HI beyond the head of the measurer to the top position TP, which is advantageous in improving the calculation accuracy of the shaft plane.

The invention claimed is:

1. A swing measurement system for measuring an evaluation index of a swing of a golf club using an inertial sensor, the swing measurement system comprising:

the inertial sensor attached to the golf club at an attachment position determined by a measurer, the inertial sensor having a rectangular shape with a length axis, a depth axis, and a width axis, wherein the length axis is aligned with an axial direction of the golf club and the depth axis is aligned parallel to a face surface of the golf club;

a movement trajectory calculation unit that calculates a movement trajectory of the golf club during the swing using a detection value of the inertial sensor at the attachment position;

a shaft plane calculation unit that calculates a shaft plane in the swing based on the movement trajectory in a freely selectable section during the swing; and an angle calculation unit that calculates a shaft plane angle formed by the face surface of the golf club with respect to the shaft plane as the evaluation index.

2. The swing measurement system according to claim 1, wherein the shaft plane calculation unit calculates the shaft plane based on the movement trajectory in a freely selectable section from an address position to an apex position of the swing, the apex position being a point at which a head of the golf club has reached a highest position during a back swing.

3. The swing measurement system according to claim 2, wherein the shaft plane calculation unit calculates the shaft plane based on the movement trajectory from a halfway back position to the apex position during the back swing.

4. The swing measurement system according to claim 2, wherein the shaft plane calculation unit calculates the shaft plane based on the movement trajectory from the address position to a halfway back position during the back swing.

5. The swing measurement system according to claim 1, wherein:

the attachment position of the inertial sensor is between a grip of the golf club and a head of the golf club; and the inertial sensor is a singular unit and is an only inertial sensor attached to the golf club.

6. A swing measurement method for measuring an evaluation index of a swing of a golf club using an inertial sensor, the swing measurement method comprising the steps of:

attaching the inertial sensor to the golf club at an attachment position determined by a measurer, the inertial sensor having a rectangular shape with a length axis, a depth axis, and a width axis;

aligning the length axis of the inertial sensor with an axial direction of the golf club;

aligning the depth axis of the inertial sensor parallel to a face surface of the golf club; and inputting the attachment position into a computer for use in calculating:

movement trajectory calculating of calculating a movement trajectory the golf club during the swing using a detection value of the inertial sensor;

shaft plane calculating of calculating a shaft plane in the swing based on the movement trajectory in a freely selectable section during the swing; and angle calculating of calculating a shaft plane angle formed by the face surface of the golf club with respect to the shaft plane as the evaluation index.

7. The swing measurement method according to claim 6, wherein in the shaft plane calculating, the shaft plane is calculated based on the movement trajectory in a freely selectable section from an address position to an apex position of the swing, the apex position being a point at which a head of the golf club has reached a highest position during a back swing.

8. The swing measurement method according to claim 7, wherein in the shaft plane calculating, the shaft plane is calculated based on the movement trajectory from a halfway back position to the apex position during the back swing.

9. The swing measurement method according to claim 7, wherein in the shaft plane calculating, the shaft plane is calculated based on the movement trajectory from the address position to a halfway back position during the back swing.

10. The swing measurement method according to claim 7, wherein:

the attachment position of the inertial sensor is between a grip of the golf club and a head of the golf club; and the inertial sensor is a singular unit and is an only inertial sensor attached to the golf club.

11. A swing measurement program configured to cause a computer to execute the calculating in the swing measurement method described in claim 6.

* * * * *